United States Patent [19]

Hutchings, II et al.

[11] Patent Number: 4,979,725

[45] Date of Patent: Dec. 25, 1990

[54] ROOF SAFETY BARRIER SUPPORTING FRAME

[75] Inventors: Robert L. Hutchings, II, Portland, Oreg.; James R. Bartlett, 395 NW. 150th, Beaverton, Oreg. 97006

[73] Assignees: Michael J. Quigley; James R. Bartlett, Portland, Oreg.

[21] Appl. No.: 336,101

[22] Filed: Apr. 11, 1989

[51] Int. Cl.[5] ..... E04H 7/18

[52] U.S. Cl. ..... 256/64; 256/59; 256/60; 256/67; 256/DIG. 6; 248/237; 248/326; 52/150; 182/82

[58] Field of Search ..... 256/23, 59, 60, 64, 256/65, 67, DIG. 6; 248/237, 324, 326, 278; 52/90, 127.2, 149, 150, 645; 182/82

[56] References Cited

U.S. PATENT DOCUMENTS

| | | | |
|---|---|---|---|
| 1,043,838 | 11/1912 | Howard | 248/237 |
| 1,205,279 | 11/1916 | Small | 248/237 |
| 1,586,421 | 5/1926 | Frush | 248/237 |
| 1,864,457 | 6/1932 | Nelson | 248/237 |
| 2,446,093 | 7/1948 | Lambert | 248/237 |
| 2,892,492 | 6/1959 | Jackoboice | 256/64 |
| 3,584,839 | 6/1971 | Dickey | 256/65 |
| 3,776,498 | 12/1973 | Peters et al. | 182/82 X |
| 3,880,405 | 4/1975 | Brueske | 256/59 |
| 3,901,481 | 8/1975 | Probst | 256/59 |
| 4,122,916 | 10/1978 | Strobel | 182/82 |
| 4,261,550 | 4/1981 | Gregory | 256/67 |
| 4,371,139 | 2/1983 | Clark | 248/237 |
| 4,666,131 | 5/1987 | Kettelkamp, Sr. et al. | 256/59 |

FOREIGN PATENT DOCUMENTS

| | | | |
|---|---|---|---|
| 2448604 | 10/1980 | France | 256/64 |
| 658134 | 10/1951 | United Kingdom | 256/DIG. 6 |

*Primary Examiner*—Randolph A. Reese
*Assistant Examiner*—Franco S. DeLiguori
*Attorney, Agent, or Firm*—Chernoff, Vilhauer, McClung & Stenzel

[57] ABSTRACT

A triangular frame assembly is disclosed for supporting a safety barrier of boards above the edge of a roof during construction. The triangular assembly employs pivotal connections between a base and a lower stanchion member, between the base and a diagonal brace, and between the diagonal brace and an upper stanchion member telescopically connected to the lower stanchion member. The angle between the stanchion and the base can be adjusted to accommodate a wide range of roof pitches by varying the telescopic engagement of the upper and lower stanchion members. The range of roof pitch angles for which the frame assembly can be used is increased by making the upper stanchion member invertable, adapting both ends thereof to alternatively telescopically engage the lower stanchion member, and by providing for an off-center brace connection to the upper stanchion member. A variation of the invention provides for a rigid triangular frame secured below the eave of a roof for supporting a stanchion extending above the eave.

3 Claims, 3 Drawing Sheets

ROOF SAFETY BARRIER SUPPORTING FRAME

BACKGROUND OF THE INVENTION

The present invention relates to safety apparatus for preventing workmen, equipment and supplies from falling off a roof during construction. More particularly, the invention relates to a supporting frame for a roof safety barrier which is readily adapted for installation on roofs having a wide range of pitches.

Workers engaged in construction activity on rooftops, particularly rooftops having a significant pitch, risk serious injury from falling. Workmen and other persons passing below construction sites are also subject to injury as a result of being struck by unsecured tools or construction materials falling from rooftops under construction. In recognition of such problems, state and federal regulations frequently require roofers to install safety barriers.

It is necessary for roof safety barriers to be sufficiently supported to resist the dynamic impact of a heavy falling object or a falling workman. Safety barriers should also be reusable, easy to install and remove, and easily transported to the job sites. Finally, such barriers should be adjustable so as to be readily adapted to various roof pitches.

Typically, roof safety barriers are constructed of wooden planks supported horizontally by a series of upright stanchions spaced at intervals along the edge of a roof. To accommodate various roof pitches, prior art barriers, as shown in Kettelkamp, Sr., et al., U.S. Pat. No. 4,666,131, and Probst, U.S. Pat. No. 3,901,481, employ adjustable connections between the stanchion and a supporting base secured to the roof so that the angle between the stanchion and the base can be adjusted according to the pitch of the roof. However, the adjustable barriers referred to above cannot withstand the dynamic impact of a heavy falling object or falling workman because their adjustable angle requires a cantilever style, stanchion-to-base interface which enables the stanchion to impose far too much leverage on the base when the barrier experiences an impact. A heavy impact can therefore disconnect the base from the roof, defeating the safety feature. Brueske U.S. Pat. No 3,880,405, shows diagonal bracing extending directly between the stanchion and the roof, which provides greatly improved impact resistance. However such structures require multiple connections to the roof, which interfere with roof surfacing operations such as shingling and provide no angle adjustability for accommodating roofs of widely varying pitch.

Moreover, none of the prior structures provides a barrier mountable along an overhanging, sloping roof eave capable of drawing its support primarily from a vertical wall beneath the overhanging eave.

SUMMARY OF THE INVENTION

The present invention is directed toward a frame assembly, for supporting a safety barrier proximate the edge of a roof, which overcomes the foregoing deficiencies.

One embodiment of the frame assembly, especially adaptable for use adjacent the lower edge of a pitched roof, includes a two-part upright stanchion variably extendable by means of a telescopic connection between upper and lower stanchion members. The lower stanchion member is pivotally joined to an elongate supporting base which is adapted to be secured to a rooftop in substantially perpendicular relation to the roof edge. One end of a diagonal brace member is also pivotally connected to the base at a point spaced from the lower stanchion member, the other end being pivotally connected to the upper stanchion member. The upper and lower stanchion members may be selectively locked in a desired telescoping relationship. The pivotal connections between the base and lower stanchion member, between the base and the diagonal brace, and between the diagonal brace and the upper stanchion member, result in a triangular frame assembly in which the angle between the stanchion and the base can be adjusted by varying the telescopic extension of the upper and lower stanchion members. In this manner the frame assembly can provide an upright safety barrier support for a wide range of roof pitches while compatibly providing impact-resistant diagonal bracing, thereby avoiding any cantilever-style, highly leveraged interface between the stanchion and the base. Preferably the pivot joint connecting the upper stanchion to the diagonal brace is mounted closer to one end of the upper stanchion member than to the other end, and the upper stanchion member is invertable so that either end can telescopically engage the lower stanchion member. The ability to invert the upper stanchion member, in combination with the off-center position of the pivot joint on the upper stanchion member, increases the range of roof pitch angles for which the frame assembly can be adapted.

According to a variation of the invention, a rigid triangular frame is mountable to a wall below a sloping roof eave for supporting a stanchion extending vertically above the eave. The frame includes an elongate leg vertically mountable to the wall, the upper end of the leg being joined to the inner end of a horizontal support member which extends outwardly from the wall beyond the edge of the eave. A diagonal brace extends between the outer end of the horizontal support member and the lower end of the leg. The base of the stanchion is preferably movably coupled to the horizontal support member so as to allow for adjustment of the spacing of the stanchion outwardly from the wall, to accommodate different eave overhang dimensions. The stanchion may further include a bracket for engaging the eave of the roof.

Accordingly, it is a principal object of the present invention to provide a roof safety barrier supporting frame of triangular construction having a mounting base, stanchion, and impact-resistant diagonal bracing which is adjustable to a wide range of roof pitches.

It is a related object to provide such an adjustable frame wherein the diagonal bracing does not require additional connections to the roof remote from the base.

It is a further object of the present invention to provide such a frame having a base connectable to the roof surface without interfering with the installation of roofing material.

It is a further object to provide such a frame which may be readily collapsed into a compact configuration for handling and transport.

It is another object to provide a rigid frame for supporting a safety barrier above an overhanging, sloping eave of a roof by connecting the frame to a vertical wall beneath the eave.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENTS

Figure 1:
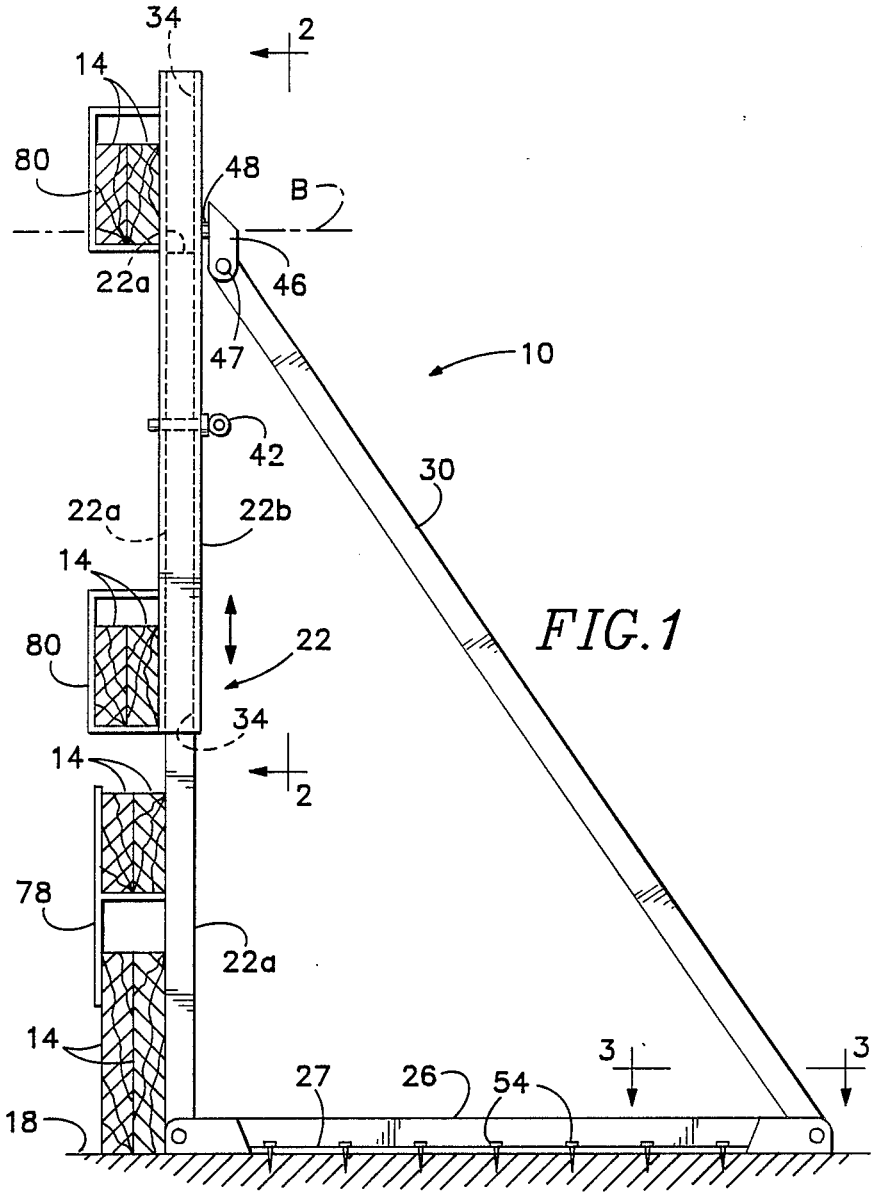
FIG. 1 is a side view of an exemplary embodiment of a frame assembly constructed in accordance with the present invention which is adjustable to accommodate different roof pitches.

Referring to FIG. 1, a frame assembly 10 for supporting a safety barrier consisting of horizontally supported boards 14 atop a roof 18 is shown. The frame assembly includes a telescopically adjustable two-part stanchion 22 having a lower stanchion member **22*a* and an upper stanchion member 22*b*, a base 26 and a diagonal brace 30**. The extendable stanchion, base and diagonal brace are all pivotally joined to each other so as to form an adjustable triangular frame assembly.

Figure 2:
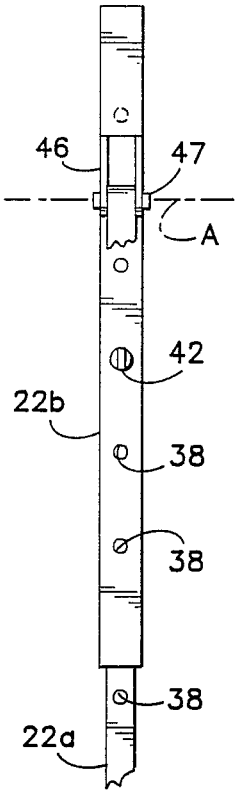
FIG. 2 is a partial rear view of the stanchion of the frame assembly, taken along line 2—2 of FIG. 1.

The stanchion 22 is preferably of tubular construction with the upper member **22*b* having an elongate bore 34 for receiving the upper end of the lower stanchion member 22*a*. As best seen in FIG. 2, the upper and lower stanchion members each include a plurality of identical transverse holes 38 through which a pin 42 can be inserted to lock the upper stanchion member in a desired extended position with respect to the lower stanchion member. The stanchion includes a forwardly projecting T-shaped board support 78 mounted on the lower stanchion member and a pair of forwardly projecting, C-shaped board supports 80** each mounted proximate a respective end of the upper stanchion member.

Figure 3:
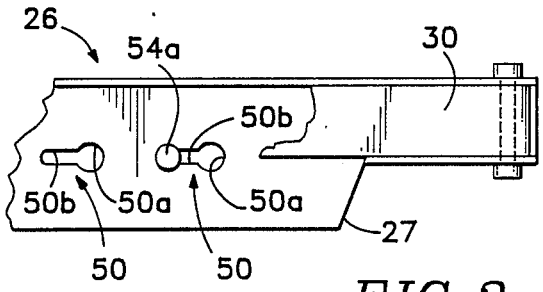
FIG. 3 is an enlarged top view of a portion of the base of the frame assembly, taken along line 3—3 of FIG. 1.
Figure 5:
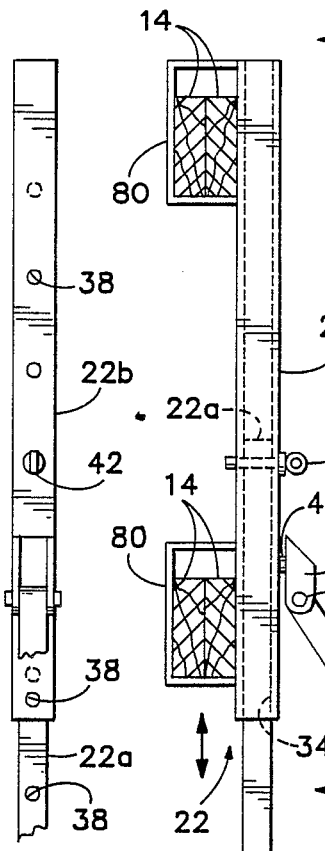
FIG. 5 is a partial rear view of the stanchion taken along line 5—5 of FIG. 4.
Figure 4:
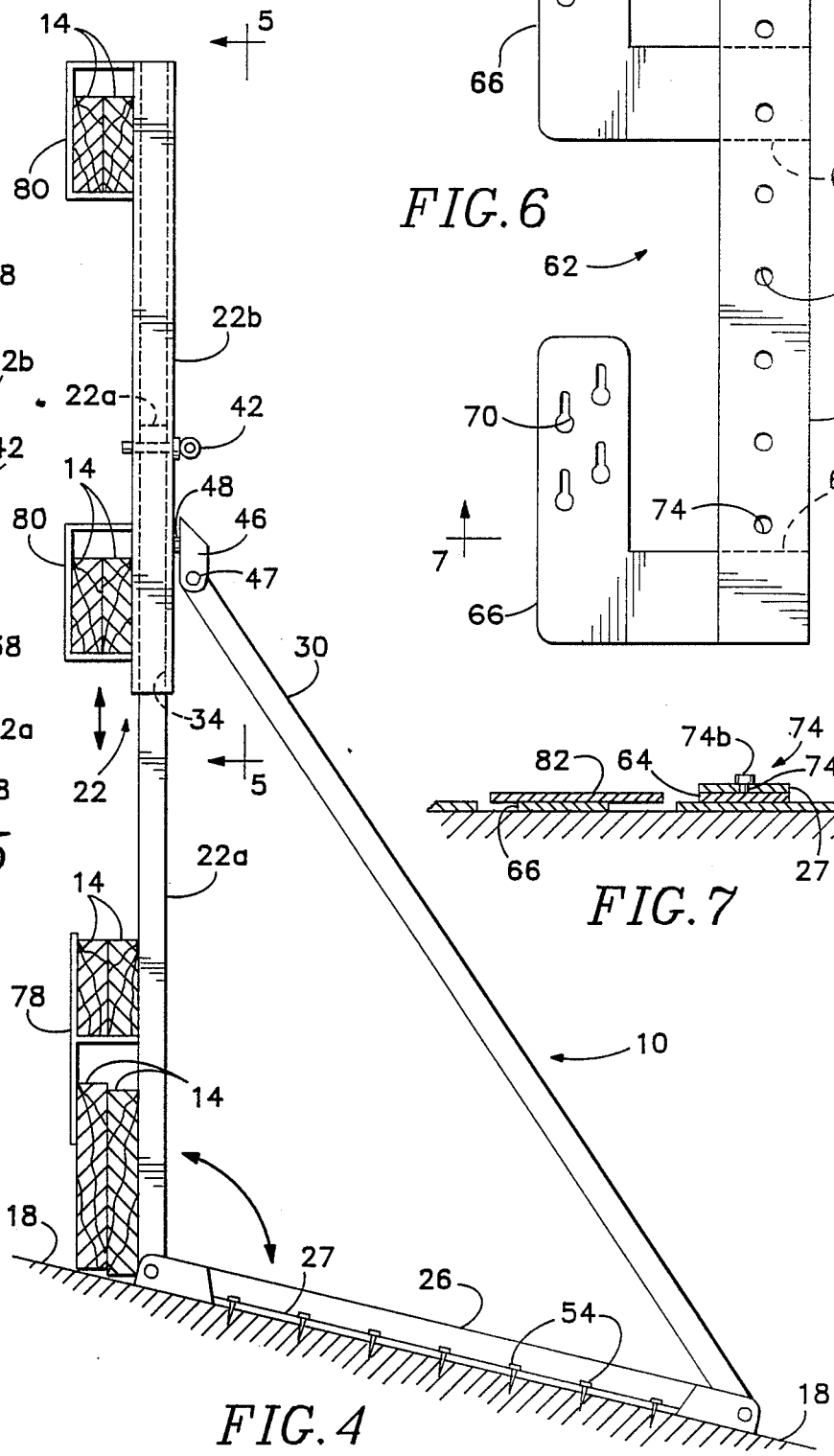
FIG. 4 is a side view of the frame assembly of FIG. 1 with the upper stanchion member inverted to accommodate greater pitches.

The elongate supporting base 26 is pivotally connected, at the forward end thereof, to the lower end of the lower stanchion member **22*a* so as to permit the stanchion to pivot about an axis which is transverse to the base. As best seen in FIG. 3, the base includes an elongate flat sill 27 having a series of keyhole-shaped apertures 50 spaced therealong. Each of the apertures includes a circular portion 50*a* and a narrowed, elongate channel portion 50*b* extending forward toward the stanchion. The diagonal brace 30 includes a lower end which is pivotally connected to the rearward end of the base so as to pivot about an axis which is transverse to the base. The upper end of the brace includes a pivot joint 46 positioned off center on the upper stanchion member 22*b*. The pivot joint enables the brace and upper stanchion member to be pivotable with respect to each other about two mutually perpendicular axes of rotation, the first axis corresponding to the longitudinal axis A (FIG. 2) of pivot pin 47 and the second axis corresponding to the longitudinal axis B (FIG. 1) of pivot post 48. Either end of the upper stanchion member 22*b* can be telescopically engaged with the lower stanchion member 22*a* by inverting the upper member 22*b* about the pivot post 48**, thereby increasing the range of roof pitch angles for which the frame assembly can be adapted. For example, FIG. 4 shows the upper stanchion member inverted from the position shown in FIG. 1 so as to enable the frame assembly to be adapted to a roof having a greater pitch.

The installation of a roof safety barrier using the above-described exemplary embodiment of the present invention would typically involve attaching multiple frame assemblies 10 spaced apart along the lower edge of a pitched roof so as to receive and support horizontally supported end-lapped boards 14. Each elongate base 26 is arranged transverse to the roof edge and preferably overlying a roof joist with the diagonal brace 30 positioned between the stanchion 22 and the roof edge. Each frame assembly may be secured to the roof using nails 54 driven into the roof through the channel portions **50*b* of the apertures of the sill 27**.

The boards 14 comprising the actual barrier are horizontally supported in end-lapped fashion between the adjacent stanchions so as to create a safety barrier along the length of the roof edge. As may be seen in FIGS. 1 and 4, the T support 78 on the lower stanchion member enables the bottom boards of the barrier to rest upon the roof itself, preventing equipment or materials from sliding beneath the barrier. Supplemental lateral bracing (not shown) may be secured directly between the roof and the stanchions at each end of the safety barrier so as to enhance lateral support of the assembled barrier.

The roof safety barrier is easily disassembled by first removing the boards 14 from the frame assemblies 10. The frame assemblies can then be released from the roof by striking each base from its rearward end in the direction of the stanchions, thereby shifting the base forward so that the nail heads **54*a* are aligned with the larger diameter circular portions 50*a* of the apertures 50. The frame assemblies 10** may then be lifted from the roof. Alternatively, the frame assemblies can be rocked sideways to pull the nails.

Figure 6:
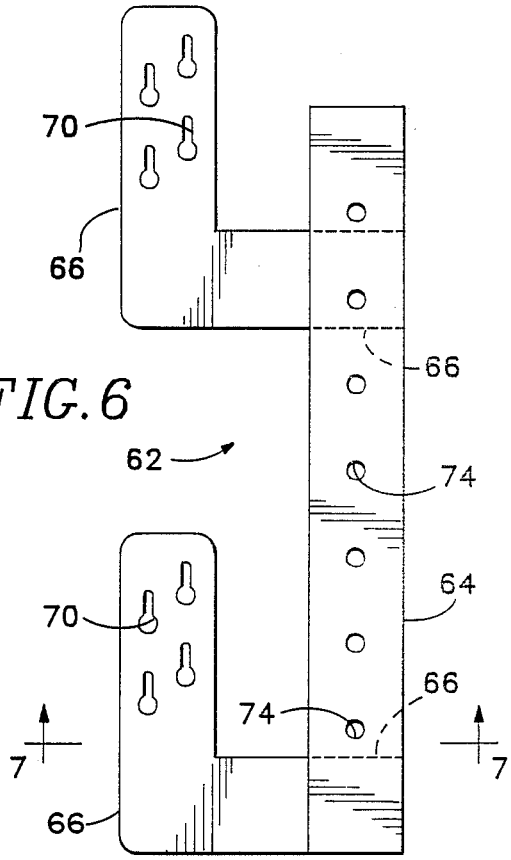
FIG. 6 is a top view of an optional mounting bracket for the frame assembly of FIGS. 1 and 4, for elevating the base of the frame assembly above the surface of the roof to permit the insertion of roofing materials beneath the base.
Figure 7:
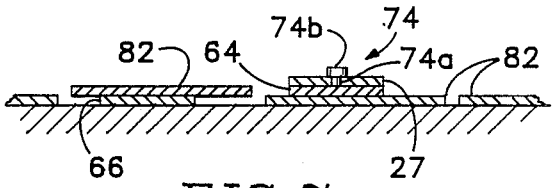
FIG. 7 is a sectional view taken along line 7—7 of FIG. 6.

FIGS. 6 and 7 show an optional mounting bracket 62 for elevating the base 26 of the frame assembly 10 above the surface of the roof so as to permit the application of roofing material such as shingles beneath the base. The mounting bracket 62 includes a pair of transversely-extending supports 66 over which roofing material can be applied. The supports 66 are secured to the roof using nails 54 driven into the roof through a plurality of forwardly directed key-shaped apertures 70, similar to apertures 50. The mounting bracket 62 includes an elongate shoe 64 extending between the supports 66 for mounting the sill 27 of the base 26, the shoe 64 being rigidly mounted atop the supports 66 so as to maintain a clearance between the shoe and the roof. The upper surface of the shoe includes a row of buttons 74 spaced along the length of the shoe corresponding to the spacing of channeled apertures 50 on the sill and adapted to be received by the apertures 50. Similar to a nail, each button includes a shaft 74*a* and a head 74*b*, the diameter of the head 74*b* being less than the diameter of the circular portions 50*a* of apertures 50 but greater than the width of the channel portions 50*b*. The base of the frame assembly is attached to the shoe by inserting the buttons 74 into the circular portions 50*a* of the apertures in the sill and then sliding the base rearwardly in the direction of the roof edge so as to position the buttons in the channel portion of the apertures as shown in FIG. 7.

The optional mounting bracket 62 is used in applications where the direct engagement of the sill 27 of the frame assembly to the roof would interfere with the installation of roofing material such as shingles. As shown in FIG. 7, the bracket 62 permits shingles 82 to be installed beneath the elevated shoe 64 and atop the supports 66. Thereafter the supports 66 may be removed from beneath the shingles 82 by sliding the mounting bracket forward to align the nail heads with the holes of the key-shaped apertures 70, lifting the supports 66 free of the nails, and sliding them rearwardly from beneath the installed shingles. The nails may then be driven into the roof.

The frame assembly 10 is collapsible into a compact, elongated configuration for convenient transport and storage. Referring to FIG. 4, the pin 42 is first removed from the stanchion 22 and the inside angle between the lower stanchion member and the base 26 is increased to 180 degrees by sliding the upper stanchion member down over the lower stanchion member. The resultant elongated collapsed assembly is then secured for transport by reinserting the pin into the stanchion 22 through an aligned set of transverse holes in both the upper and lower stanchion members.

Figure 8:
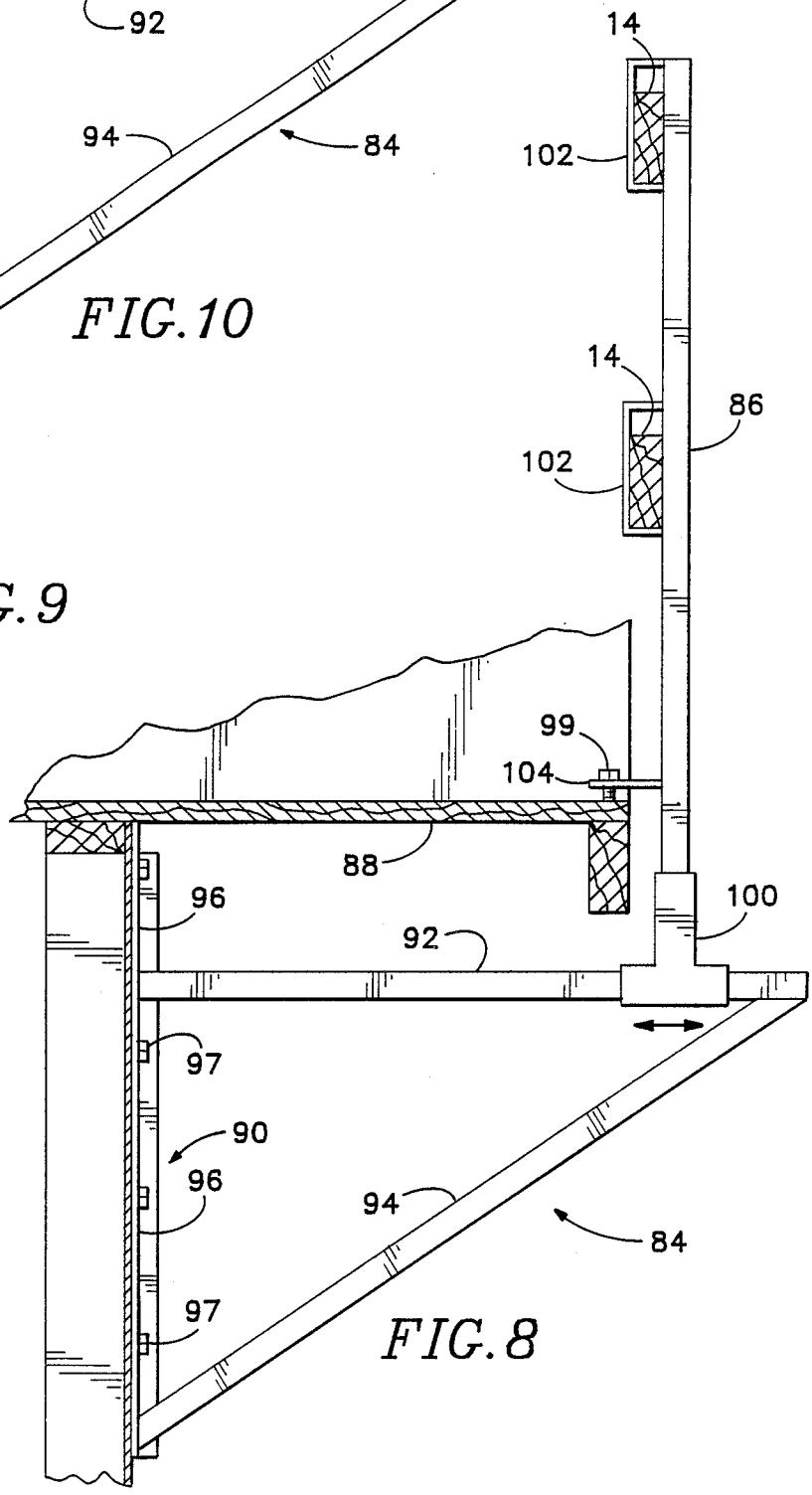
FIG. 8 is a side view of a different frame assembly, utilized for supporting a safety barrier above the sloping eave of a roof.

Referring to FIG. 8, a frame assembly 84 for supporting a safety barrier above the sloping eave 88 of a roof is shown. The frame assembly includes a vertical leg 90, a horizontal rectangular support bar 92 extending out from the upper end of the leg, and a diagonal brace 94 extending between the outer end of the support bar and the lower end of the leg forming a rigid triangular structure. The leg 90 includes an elongate flat sill 96 having a series of keyhole shaped apertures, not shown, adapted to be employed in a manner similar to that described above to detachably secure the leg to the studs of a vertical wall beneath the eave by means of nails 97.

A rectangular, horizontally slidable coupling sleeve 100 joins a stanchion 86 removably to the horizontal support bar 92, the stanchion 86 including a pair of forwardly projecting C-shaped board supports 102 and a bracket 104 extending inwardly, toward the roof, from a point on the stanchion below the board supports. The bracket 94 has an aperture through which a nail 99 may be driven into the edge of the eave 88.

The installation of a roof safety barrier along the eave of a roof employing this exemplary frame assembly involves the attaching of multiple frame assemblies 84 spaced apart beneath the roof eave so as to receive and support horizontal boards 14. Each leg 90 of a frame assembly is installed vertially onto a respective wall stud below the eave with the brace 94 positioned beneath the support bar 92 and the coupling 100 adjusted to position the stanchion 86 beyond the eave. The slidable coupling 100 is positioned proximate the edge of the roof eave with the bracket 104 positioned to overlap the edge of the roof to enable engagement of the nail 99 with the roof edge. The bracket 104 serves as a fulcrum about which outwardly directed forces acting upon the stanchion 86 are transferred inwardly by support bar 92 and brace 94 to the vertical wall. The safety barrier is easily detached from the building by first removing the boards 14 from the stanchions 86 and the nails 99 from the brackets 104. The frame assemblies 84 are then released from below the eave by striking each leg upwardly from the lower end so as to shift each sill 96 so that the nail heads are aligned with the larger diameter circular portions of the keyhole apertures. Each frame assembly 84 can then be easily removed from its respective stud.

Figure 9:
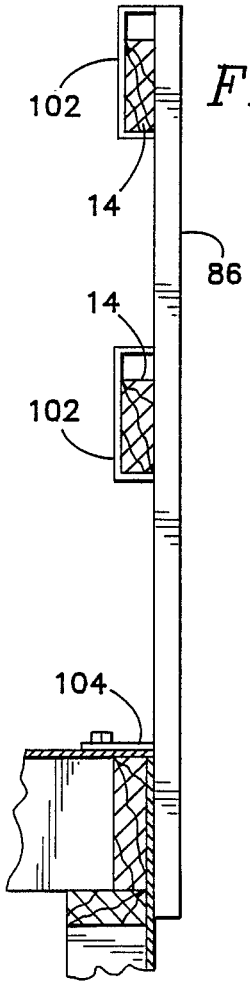
FIG. 9 is a side view of the stanchion portion of the frame assembly of FIG. 8 mounted adjacent to a roof edge having no overhanging eave.

FIG. 9 illustrates a modification of the roof barrier assembly of FIG. 8 showing installation of a stanchion 86 directly to the edge of a roof without an eave and without utilizing a frame 84. The stanchion is installed by positioning the portion of the stanchion extending below the bracket 104 against the vertical wall with the bracket 104 positioned for engagement with the top of the roof. The bracket is then secured by a nail driven into the roof through the aperture in the bracket. Boards 14 are then horizontally supported, as before, between adjacent stanchions mounted at desired intervals along the roof edge. Here the bracket 104 serves as a fulcrum about which outwardly directed forces acting upon the stanchion above the bracket are transferred directly into the vertical wall by the segment of the stanchion below the bracket.

Figure 10:
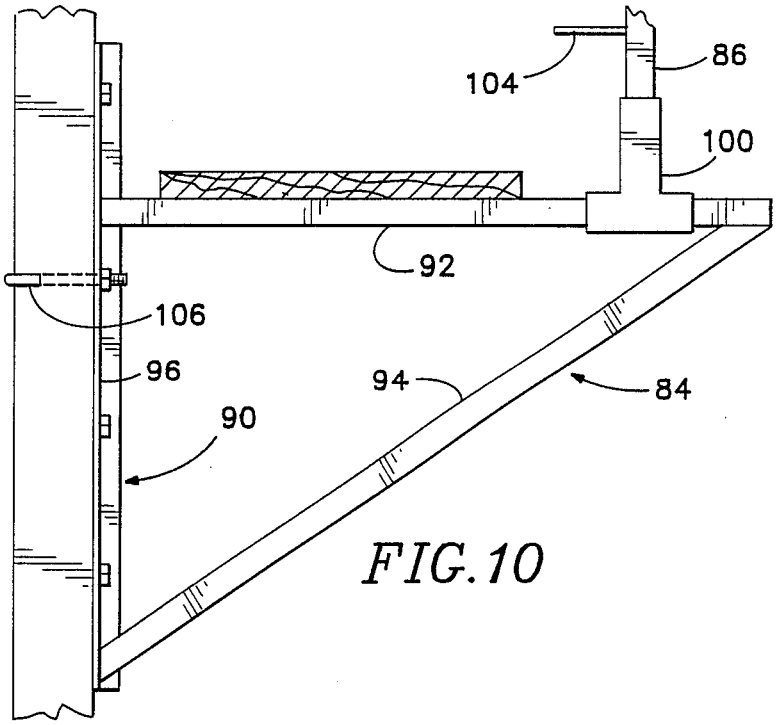
FIG. 10 is a side view of the frame assembly of FIG. 8 employed as a scaffold support.

As shown in FIG. 10 the roof barrier frame assembly 84 of FIG. 8 can also be adapted to provide a scaffolding frame assembly for supporting planks horizontally along the wall of a structure. Such an installation requires the attachment of multiple frame assemblies 84 to the studs of the wall at a desired height. Each frame assembly is secured to a respective stud using a J bolt 106 hooked around the stud with the threaded end extending through one of the keyhole apertures of the sill 96, and with nails driven through the remaining apertures. The slidable coupling 100 is positioned at the outer end of the support bar 92 to allow for the placement of planks atop the support bar and to provide for the horizontal support of boards by the stanchion to create a safety barrier for workmen using the scaffolding.

It will be appreciated by one skilled in the art that the connection between the bracket 104 and the stanchion 86 can be modified to provide for vertical adjustability of the bracket connection to the stanchion so as to readily adapt to various roof configurations.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In combination with a building having a roof defining a roof edge, a device for erecting a vertically extending upright safety barrier upon said roof, said device comprising:

(a) an elongate base secured to the surface of said roof substantially along the length of said elongate base and positioned substantially perpendicular to said roof edge, said base having a first end and a second end, said base arranged upon said roof so that said first end is positioned closer to said roof edge than said second end;

(b) a substantially vertical, upright stanchion pivotally connected to said second end of said base, said stanchion including variable extension means for selectively varying the height of said upright stanchion and selectively lockable adjustment means for locking said stanchion in a desired extended position;

(c) an elongate diagonal brace having a top end and a bottom end, said bottom end pivotally connected to said first end of said base and said top end pivotally connected to an upper portion of said upright stanchion;

(d) said upright stanchion including an upper elongate member and a lower elongate member adapted to telescopically engage each other to form said variable extension means, said upper elongate member having two ends, either end being alternatively telescopically engagable with said lower elongate member of said upright stanchion; and (e) further including a pivot joint interconnecting said top end of said brace and said upper elongate member, said joint including means for enabling said brace and upper elongate member to pivot relative to each other about at least two mutually perpendicular axes of rotation which are both oriented transversely to the length of said upper elongate member so as to permit said upper elongate member to be inverted with respect to said lower elongate member while attached to said brace.

2. The device of claim 1 wherein said pivot joint is spaced respective disparate distances from said ends of said upper elongate member.

3. The device of claim 1 including means for connecting said base to said roof so as to provide a clearance between said base and said roof sufficient to permit roofing materials to be interposed between said base and said roof.

* * * * *